United States Patent [19]

Szajewski et al.

[11] Patent Number: 5,021,555

[45] Date of Patent: Jun. 4, 1991

[54] COLOR PHOTOGRAPHIC MATERIAL

[75] Inventors: Richard P. Szajewski; Terry R. Taber, both of Rochester, N.Y.

[73] Assignee: Eastman Kodak Company, Rochester, N.Y.

[21] Appl. No.: 534,829

[22] Filed: Jun. 7, 1990

Related U.S. Application Data

[63] Continuation-in-part of Ser. No. 213,415, Jun. 30, 1988, abandoned.

[51] Int. Cl.[5] ..... G03C 7/305; G03C 7/34

[52] U.S. Cl. ..... 430/544; 430/549; 430/552; 430/553; 430/957

[58] Field of Search ..... 430/552, 553, 544, 549, 430/957

[56] References Cited

U.S. PATENT DOCUMENTS

| | | | |
|---|---|---|---|
| 4,248,962 | 2/1981 | Lau | 430/382 |
| 4,333,999 | 6/1982 | Lau | 430/17 |
| 4,409,323 | 10/1983 | Sato et al. | 430/544 |
| 4,434,225 | 2/1984 | Sugita et al. | 430/544 |
| 4,528,263 | 7/1985 | Sugita et al. | 430/553 |
| 4,609,619 | 9/1986 | Katoh et al. | 430/553 |
| 4,684,604 | 8/1987 | Harder | 430/375 |
| 4,775,616 | 10/1988 | Kilminster et al. | 430/553 |
| 4,849,328 | 7/1989 | Hoke et al. | 430/553 |

FOREIGN PATENT DOCUMENTS 167168 1/1986 European Pat. Off. .

*Primary Examiner*—Charles L. Bowers, Jr.

*Assistant Examiner*—Lee C. Wright

*Attorney, Agent, or Firm*—Joshua G. Levitt

[57] ABSTRACT

A color photographic material with good photographic performance, such as sharpness, speed and granularity, contains a development inhibitor releasing compound having the structure:

I.

wherein:

CAR is a carrier moiety;

TIME is a timing group; and

INH is a development inhibitor moiety, in association with a cyan dye-forming coupler having the structure:

II.

wherein:

$R^1$, $R^2$, $R^3$, Q, Z, Y, m, and n are as defined in the specification.

10 Claims, No Drawings

COLOR PHOTOGRAPHIC MATERIAL

This application is a continuation-in-part of U.S. Ser. No. 213,415 filed Jun. 30, 1988 now abandoned.

FIELD OF THE INVENTION

This application relates to color photographic materials. In a particular aspect, it relates to color photographic materials with a particular combination of development inhibitor releasing compound and cyan dye-forming coupler.

BACKGROUND OF THE INVENTION

Photographic couplers which release a development inhibitor in a controlled manner are described in U.S. Pat. Nos. 4,248,962 and 4,409,323, inter alia. These couplers comprise a coupler moiety which has a timing group joined in its coupling position. A development inhibitor is attached to the timing group and is released from it after the bond between the timing group and the coupler is cleaved as a result of reaction between the coupler and oxidized color developing agent. Mechanisms by which such release of the development inhibitor from the timing group can occur include an intermolecular nucleophilic displacement reaction, an electron transfer reaction, and a hydrolysis reaction. Development inhibitors also can be released, as a function of development, from timing groups which are released from compounds which are not couplers such as the hydrazides of U.S. Pat. No. 4,684,604 and the hydroquinones of European Patent Application No. 0,167,168.

One of the advantageous effects obtained as a result of release of a development inhibitor, either directly from a coupler or other carrier moiety, or through a timing group as described above, is an improvement in photographic performance, such as an improvement in the sharpness of the image formed.

Also known are cyan dye-forming image couplers that contain a ureido group in the 2-position.

Lau, U.S. Pat. No. 4,333,999 issued Jun. 8, 1982, describes cyan dye-forming couplers containing p-cyanophenylureido substituents in the 2-position of the coupler. These couplers are described as yielding dyes having desirable hues and good stability properties.

U.S. Pat. Nos. 4,777,616 and 4,849,328 describe couplers which improve upon those described in the '999 patent by modifying the 5-position substituent. The '999, '616, and '328 patents suggest the use of the cyan couplers therein described in combination with DIR couplers, but do not specifically suggest that they be used with couplers of the type described in the '962 or '323 patents.

U.S. Pat. Nos. 4,434,225 and 4,609,619 describe phenolic cyan dye-forming couplers containing a ureido group in the 2-position. Use of one of these couplers with a DIR coupler is mentioned in these patents. However, they do not describe any particular combination of phenolic coupler and DIR coupler nor the particular advantage deriving from the selection of the present invention.

It would be desirable to provide color photographic materials which have improved performance.

SUMMARY OF THE INVENTION

We have found that unexpected improvements in photographic performance, such as sharpness, speed and granularity, can be obtained with a photographic element comprising a support bearing a silver halide emulsion layer having associated therewith a DIR compound having the structure I:

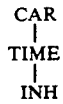

I.

wherein:

CAR is a carrier moiety,

TIME is a timing group and

INH is a development inhibitor moiety; together with a cyan dye-forming coupler having the structure II:

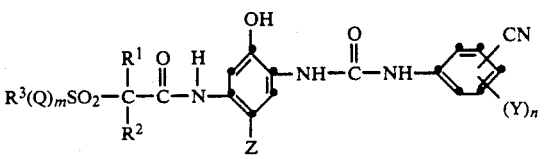

II.

wherein:

m is 0 or 1;

n is 0, 1 or 2;

Y is halogen, or sulfonyl;

Q is —O— or —NH—;

$R^1$ is an unsubstituted or a substituted, straight or branched chain alkyl group having from 1 to about 20 carbon atoms, an unsubstituted or a substituted cycloalkyl group having from 3 to about 8 carbon atoms in the ring, an alkylcarbonyl or an alkoxycarbonyl group having from 1 to about 20 carbon atoms in the alkyl or the alkoxy moiety;

$R^2$ is as defined for $R^1$ or is hydrogen;

$R^3$ is an unsubstituted or a substituted alkyl group having from 1 to about 24 carbon atoms, an unsubstituted or a substituted cycloalkyl group having from 3 to about 8 carbon atoms in the ring, an unsubstituted or a substituted aryl group having from 6 to about 24 carbon atoms, or an unsubstituted or a substituted heterocyclic group having from 3 to about 8 atoms in the heterocyclic ring, wherein the hetero ring atoms can be nitrogen, oxygen, or sulfur;

when $R^3$ is a primary alkyl group, $R^1$ contains at least 2 carbon atoms;

Z is hydrogen or a coupling-off group; and the —CN substituent on the phenyl ureido group is para or meta to the ureido group.

DETAILED DESCRIPTION OF THE INVENTION

When the $R^1$ and $R^2$ groups are substituted, such substituents include hydroxy, halogen, or alkoxy having from 1 to about 8 carbon atoms.

When the $R^3$ group is substituted, such substituents include alkyl, aryl, alkoxy, aryloxy, alkylthio, arylthio, hydroxy, halogen, alkoxycarbonyl, aryloxycarbonyl, carboxy, acyl, acyloxy, carbonamido, carbamoyl, alkylsulfonyl, arylsulfonyl, sulfonamido and sulfamoyl groups wherein the alkyl and aryl substituents, and the alkyl and aryl moieties of the alkoxy, aryloxy, alkylthio, arylthio, alkoxycarbonyl, arylcarbonyl, acyl, acyloxy, carbonamido, carbamoyl, alkylsulfonyl, arylsulfonyl, sulfonamido and sulfamoyl substituents can contain, respectively, from 1 to about 10 carbon atoms and from 6 to about 30 carbon atoms and can be further substituted with such substituents.

Coupling off groups defined by Z are well known to those skilled in the art.

Representative classes of coupling-off groups include alkoxy, aryloxy, heteroyloxy, sulfonyloxy, acyloxy, acyl, heterocyclyl, sulfonamido, phosphonyloxy and arylazo. These coupling-off groups are described in the art, for example, in U.S. Pat. Nos. 2,455,169; 3,227,551; 3,432,521; 3,476,563; 3,617,291; 3,880,661; 4,052,212; 4,134,766; 4,753,871; 4,775,616; 4,849,328; and 4,923,791; and in U.K. Patents and published application Nos. 1,466,728; 1,531,927; 1,533,039; 2,006,755A and 2,017,704A.

Examples of suitable coupling-off groups which can be represented by Z are:

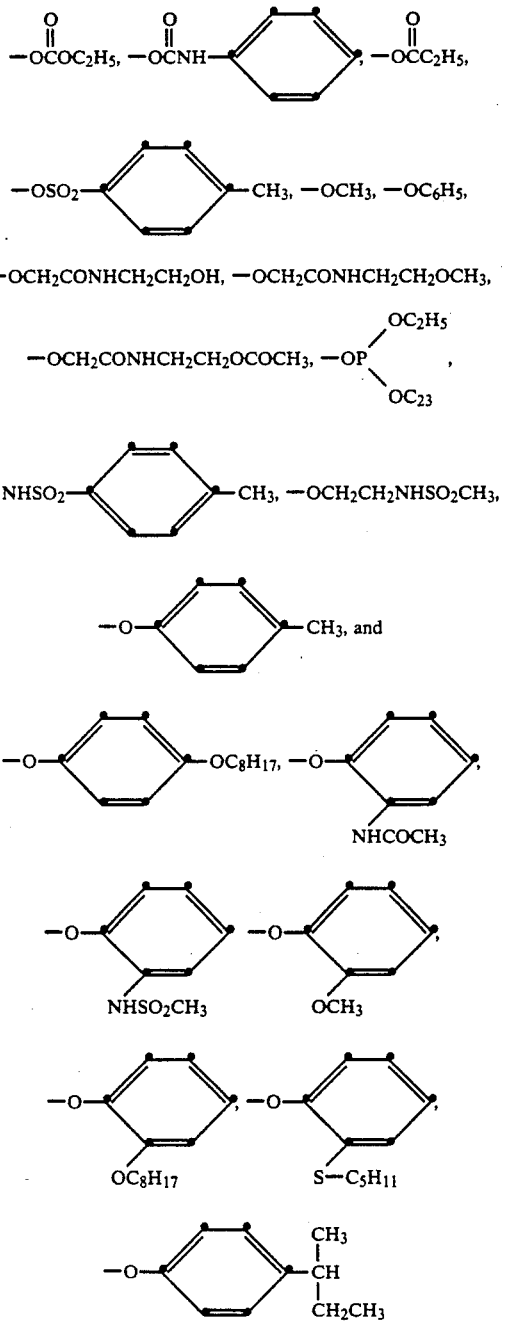

Especially preferred Z groups are hydrogen and

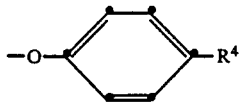

where $R^4$ is an alkyl or an alkoxy group having from 1 to about 10 carbon atoms.

While improvements in sharpness are obtained when couplers of Structure II, above, are used in combination with DIR compounds of Structure I above, especially advantageous effects are obtained with the following preferred couplers of Structure II:

In a preferred embodiment the cyano group is in the para position with respect to the ureido group and n is 0.

In a particular preferred embodiment, n is 0, the cyano group is para to the ureido group, $R^1$ is alkyl of 1 to about 20 carbon atoms and $R^2$ is hydrogen or alkyl of 1 to about 4 carbon atoms.

In an especially preferred embodiment, n is 0, the cyano group is para to the ureido group, $R^1$ is alkyl of 1 to about 14 carbon atoms, $R^2$ is hydrogen and $R^3$ is alkyl of 2 to about 24 carbon atoms.

The DIR compounds which satisfy Structure I are known in the art and are described in such patents as U.S. Pat. Nos. 4,248,962; 4,409,323; 4,684,604; 4,737,451; U.K. Patent Application No. 2,099,167; and EP Published Applications Nos. 167,168 and 255,085, as well as in U.S. Pat. Nos. 4,546,073; 4,564,587; 4,618,571; 4,698,297; and OLS No. 3,307,506. Other useful DIR compounds are described in DeSelms and Kapecki U.S. Pat. No. 4,782,012 issued Nov. 1, 1988; Szajewski, Poslusny and Slusarek U.S. patent application Ser. No. 334,261, filed Apr. 6, 1989, which is a continuation-in-part of Ser. No. 209,741, filed Jun. 21, 1988; Begley, Carmody and Buchanan U.S. Pat. Nos. 4,847,185 issued Jul. 11, 1989 and 4,857,440 issued Aug. 15, 1989; and Begley et al. U.S. patent application Nos. 483,600; 483,601; and 483,602 filed Feb. 22, 1990.

The carrier moiety, represented by CAR, can be any moiety which, as a result of reaction with oxidized color developing agent, will release the timing group. Preferably the carrier is a coupler, but it can be another group, such a hydrazide, a hydrazine or a hydroquinone. Coupler moieties can form a colored or colorless, diffusible or nondiffusible, reaction product with oxidized color developing agent. Preferred are cyan dye-forming coupler moieties.

When the carrier is a coupler moiety, the DIR compounds are DIR couplers represented by the structure

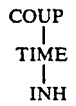

where COUP is a coupler moiety.

Particularly preferred are couplers where COUP is a naphtholic cyan dye-forming coupler moiety represented by the following generalized structure:

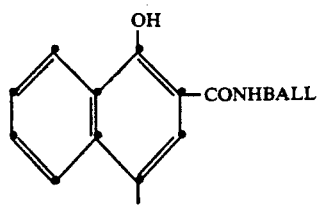

where:

the unsatisfied bond represents the point of attachment of the timing group, and BALL is a ballast group such as aryl and alkyl, especially alkoxyaryl and aryloxyalkyl.

Also useful are compounds where COUP is a yellow dye forming coupler moiety having one of the structures

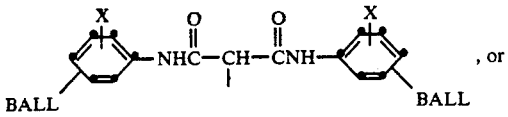

, or

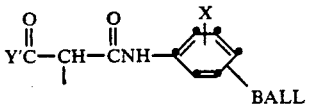

where the unsatisfied bond is the point of attachment to the timing group,

BALL is a ballast group such as alkoxycarbonyl, alkoxy, alkylsulfonamido and alkylsulfamyl, X is as defined below, and Y' is alkyl such as methyl and t-butyl, and aryl such as phenyl and alkoxy phenyl.

Preferred timing groups, represented by TIME, for use in these couplers are described in the aforementioned '962 and '323 patents and European Patent Application No. 0255085.

Particularly preferred are those timing groups which have the structures:

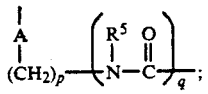

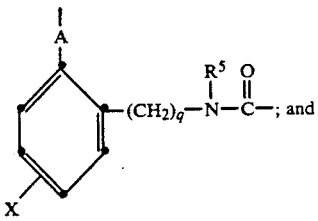

-continued

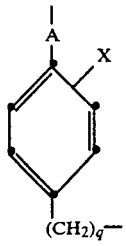

where:

p is 1 to 4;

q is 0 or 1;

A is —O— or

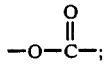

$R^5$ is hydrogen, alkyl of 1–20 carbon atoms or aryl of 6 to 20 carbon atoms; and X is hydrogen and one or more substituents independently selected from hydroxy, cyano, fluoro, chloro, bromo, iodo, nitro, alkyl, alkoxy, aryl, aryloxy, alkoxycarbonyl, aryloxycarbonyl, carbonamido, and sulfonamido.

Especially preferred are those timing groups having the structure:

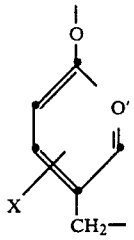

wherein

X is as defined above;

Q' is —N= or

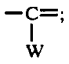

and

W is a group characterized by a $\sigma_m$ value greater than 0.0 ($\sigma_m$ is determined as described in Hansch and Leo, Journal of Medicinal Chemistry, 16, 1207, 1973). Typical W groups are $—NO_2$, $—NHSO_2CH_3$, $—NHSO_2C_{16}H_{33}$, $—NHCOCH_3$, $—NHCOC_{11}H_{23}$, —Cl, —Br, $—OCH_3$, $—OCH_2CH_2OCH_3$, etc.

The development inhibitor which is eventually released from the DIR coupler can be any of the development inhibitors known in the art, such as mercaptotetrazoles, selinotetrazoles, mercaptobenzothiazoles, selinobenzothiazoles, mercaptobenzoxazoles, selinobenzoxazoles, mercaptobenzimidazoles, selinobenzimidazoles, benzotriazoles, tetrazoles, triazoles, thiadiazoles, and benzodiazoles. Preferred are mercaptotetrazole inhibitors, benzotriazole inhibitors, and oxadiazole inhibitors. Particularly preferred are those inhibitors which are substituted with groups that cause them to be deactivated when they diffuse into processing solution. Such inhibitors are described in U.S. Pat. No. 4,477,563, U.K. Patent Application No. 2,099,167 and U.S. Pat. No. 4,782,012. Other useful inhibitors are described in Japanese Published Patent Application Nos. 60-233650, 60-225156, 60-182438 and European Published Patent Application Nos. 0167168, 0101621, 0192199, 0157146.

Examples of preferred couplers which satisfy structures I and II, respectively, are shown in Tables I and II below:

TABLE I

Specific DIR couplers that are useful in the invention have the structures:

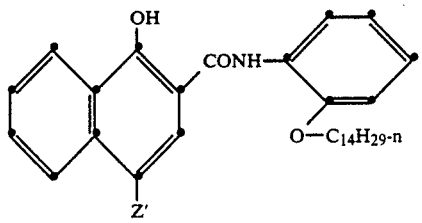

I-1

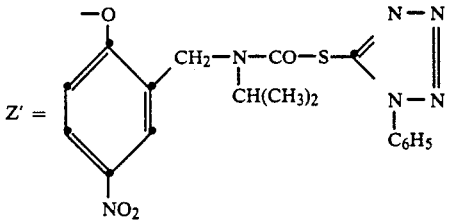

I-2

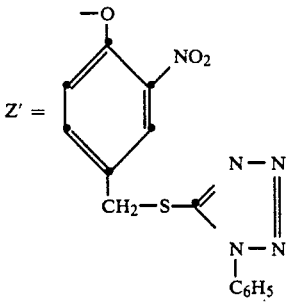

I-3

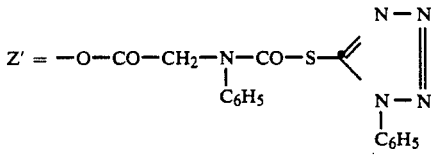

I-4

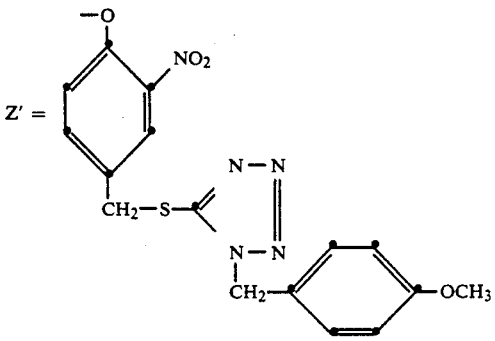

TABLE I-continued
Specific DIR couplers that are useful in the invention have the structures:
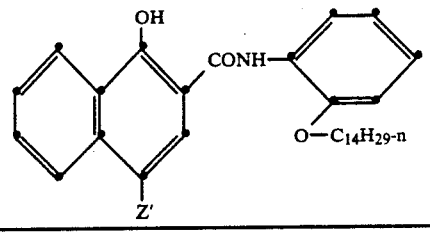
I-5
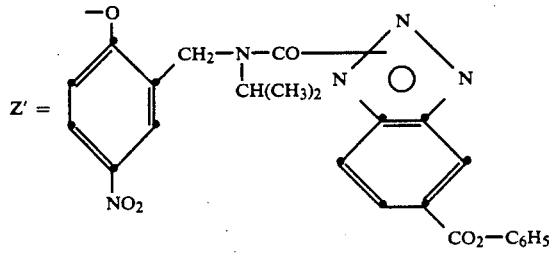
I-6
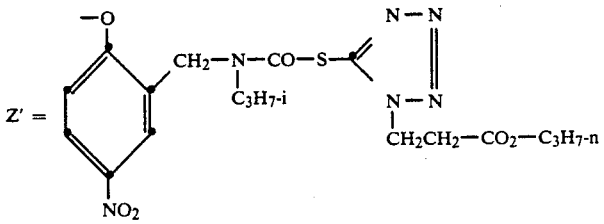
I-7
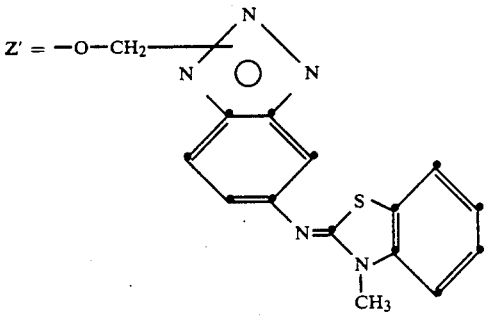
I-8
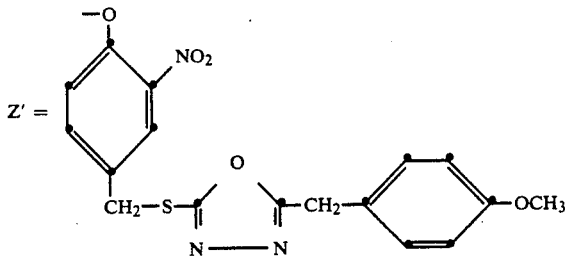
I-9
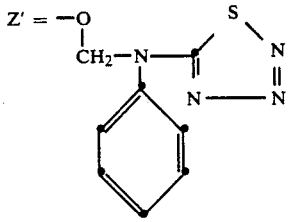

TABLE I-continued
Specific DIR couplers that are useful in the invention have the structures:
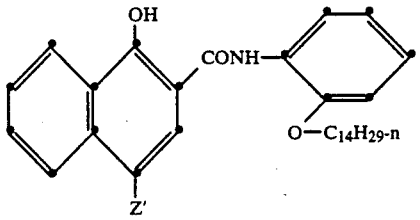
I-10
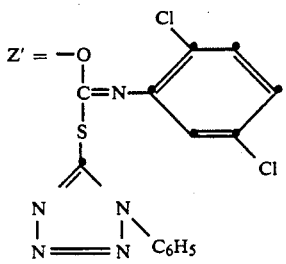
I-11
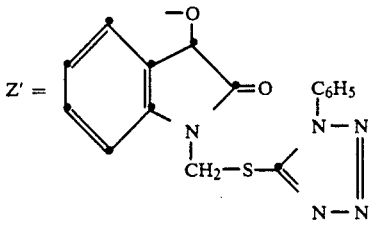
I-12
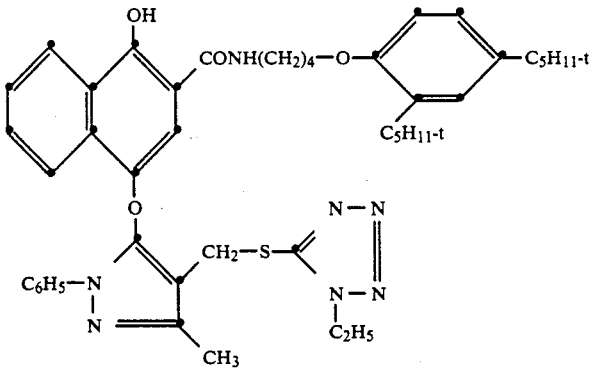
I-13
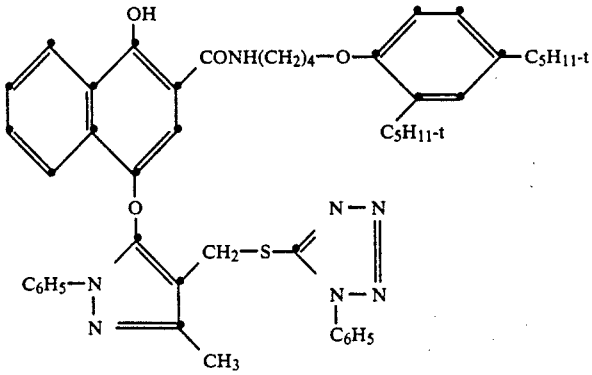

TABLE I-continued
Specific DIR couplers that are useful in the invention have the structures:
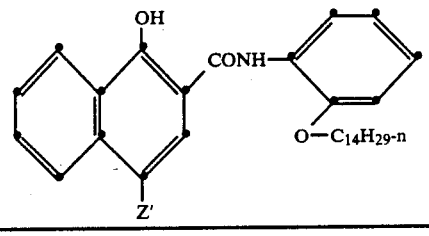
I-14
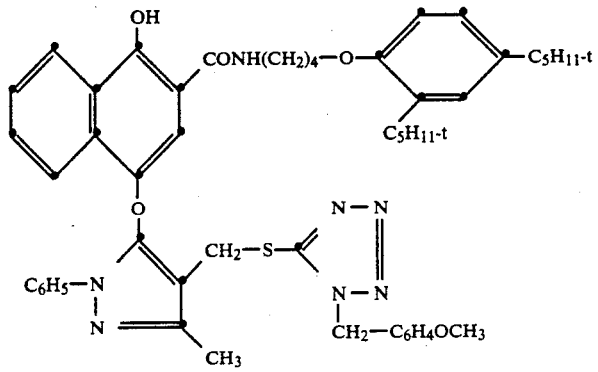
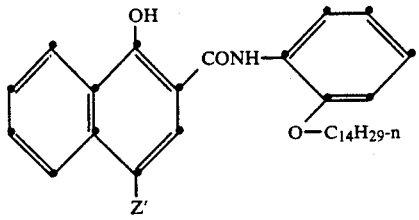
I-15
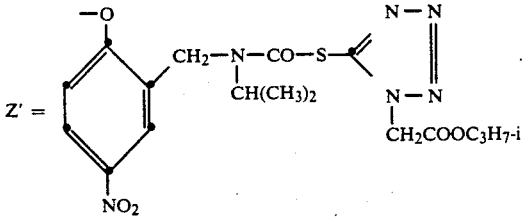
I-16
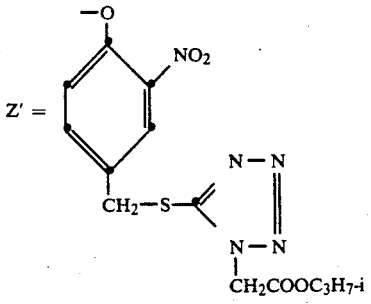
I-17
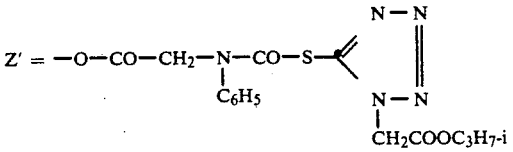

TABLE I-continued
Specific DIR couplers that are useful in the invention have the structures:
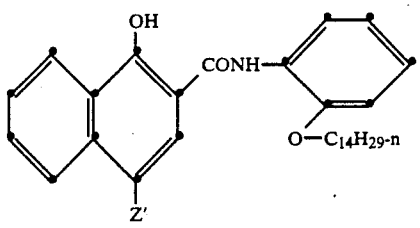
I-18
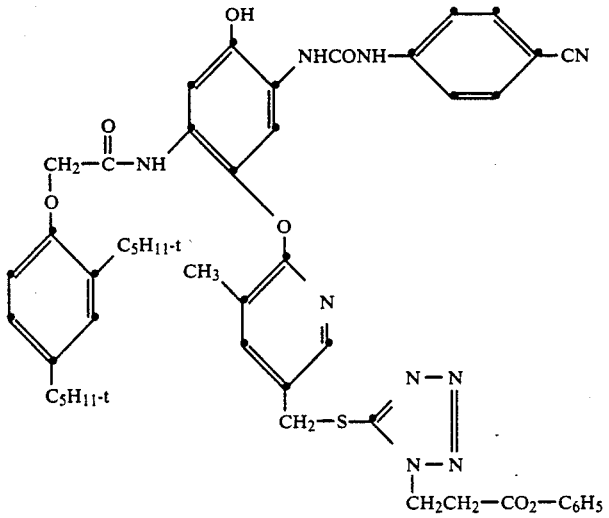
I-19
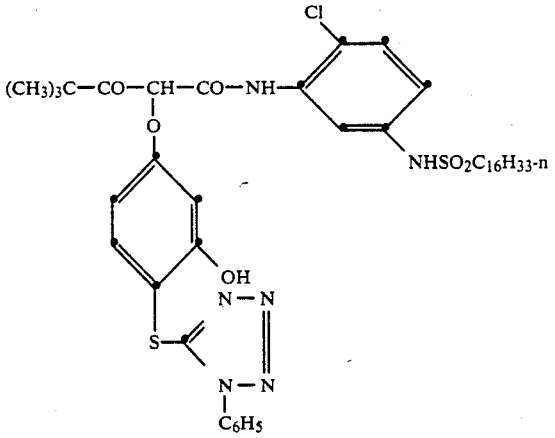
I-20
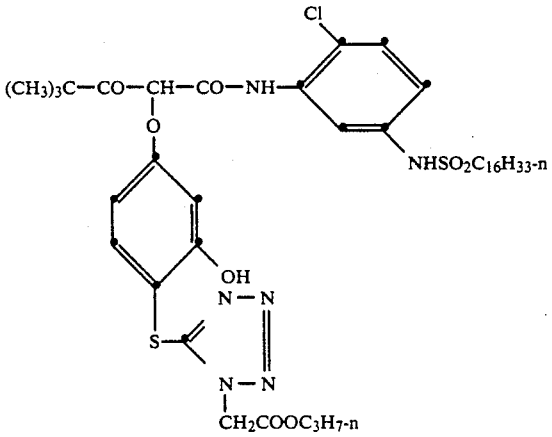

TABLE I-continued
Specific DIR couplers that are useful in the invention have the structures:
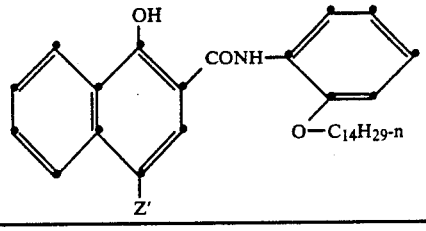
I-21
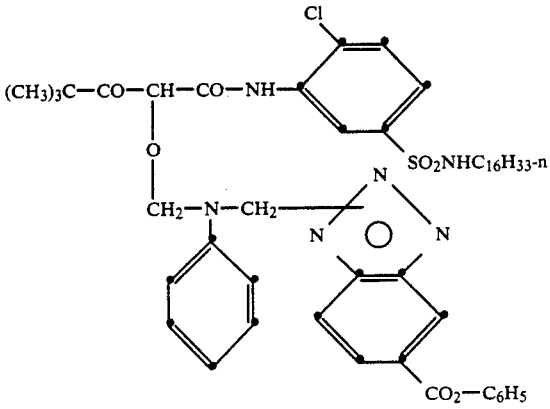
I-22
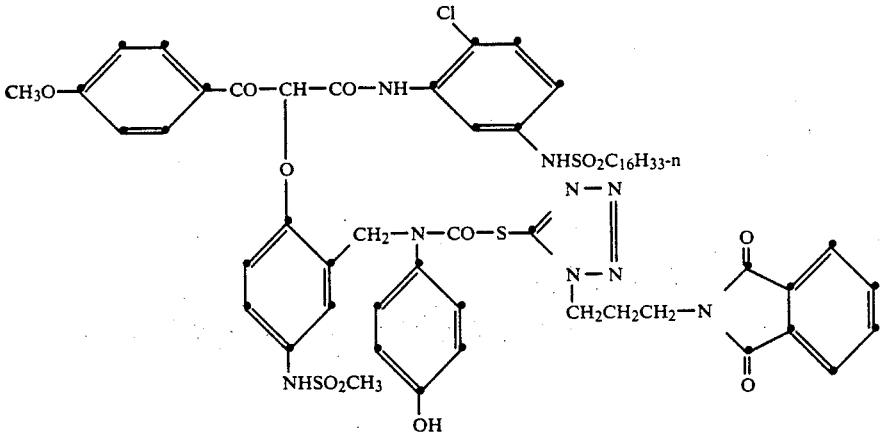
I-23
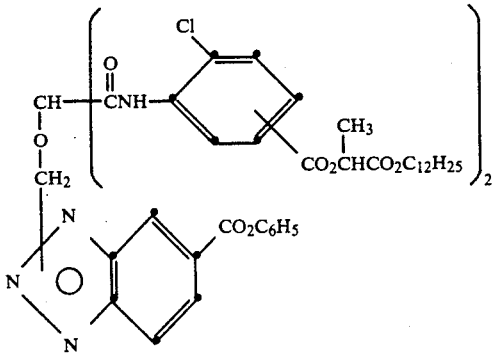

TABLE I-continued

Specific DIR couplers that are useful in the invention have the structures:

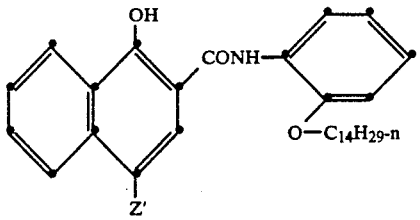

I-24

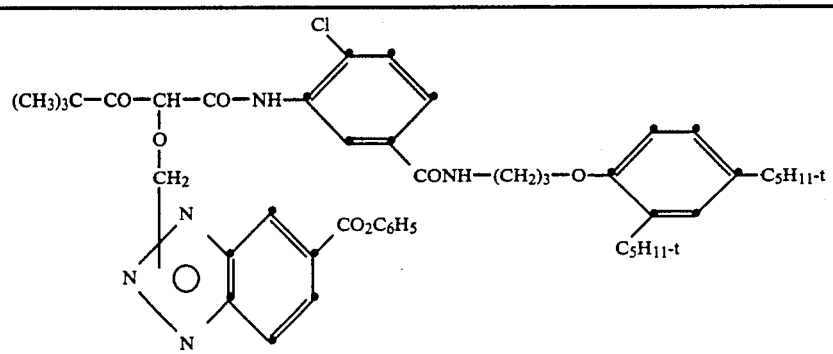

I-25

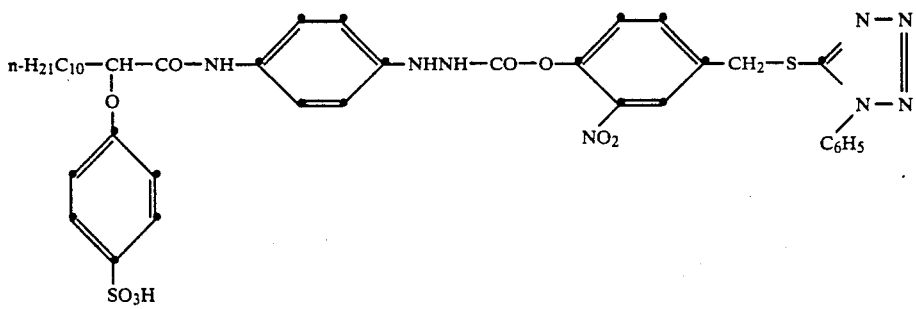

TABLE II

Specific Image coupler that are useful in the invention have the structures

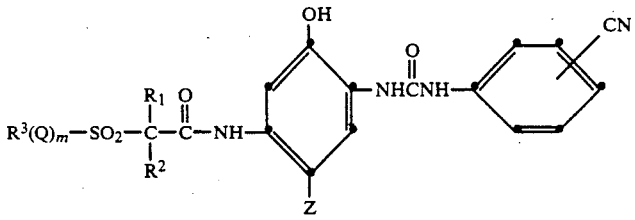

| | $R_1$ | $R_2$ | $R_3$ | Q | m | Z | —CN |
|---|---|---|---|---|---|---|---|
| II-1 | $-C_2H_5$ | —H | $-C_{16}H_{33}$-n | | 0 | $-O-C_6H_4-OCH_3$ | para |
| II-2 | $-C_2H_5$ | —H | " | | " | H | " |
| II-3 | $-C_3H_7$-i | —H | " | | " | H | " |
| II-4 | " | —H | " | | " | $-OC_6H_4OCH_3$ | " |
| II-5 | $-C_2H_5$ | —H | " | | " | " | meta |
| II-6 | $-C_3H_7$-i | —H | " | —O— | 1 | " | para |
| II-7 | $-C_2H_5$ | $-(CH_2)_3CO_2C_3H_7$ | $-C_{16}H_{33}$-n | —O— | 1 | H | para |
| II-8 | $-C_2H_5$ | $-C_2H_5$ | 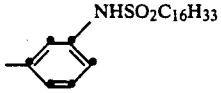 | —NH— | 1 | $-O-C_6H_4OCH_3$ | para |
| II-9 | $-C_{14}H_{29}$ | —H | $-CH_3$ | —O— | 1 | " | para |
| II-10 | $-C_{10}H_{21}$ | —H | 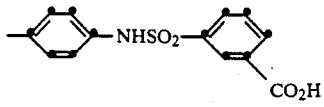 | —NH— | 1 | " | meta |

TABLE II-continued

Specific Image coupler that are useful in the invention have the structures

| | | | | | | | | |
|---|---|---|---|---|---|---|---|---|
| II-11 | $-C_4H_{9}$-n | $-H$ | $-C_6H_{11}$-cyclo | $-NH-$ | 1 | H | meta |
| II-12 | $-C_2H_5$ | $-H$ | 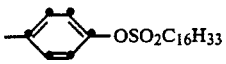 | $-O-$ | 1 | $-O-C_6H_4OCH_3$ | para |
| II-13 | $-C_4H_{9}$-t | $-H$ | $-C_{16}H_{33}$-n | $-O-$ | 1 | " | para |
| II-14 | $-C_2H_5$ | $-H$ | 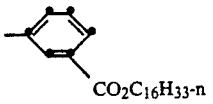 | $-NH-$ | 1 | " | para |
| II-15 | $-C_3H_7$-i | $-H$ | 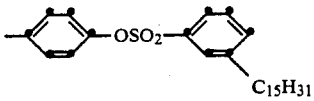 | $-O-$ | 1 | $-O-C_6H_4OCH_3$ | meta |
| II-16 | $-C_3H_7$-i | $-H$ | $-C_{14}H_{29}$-n | — | 0 | H | para |
| II-17 | $-C_3H_7$-i | $-H$ | $-C_{14}H_{29}$-n | — | 0 | $-O-C_6H_4-C_4H_{9}$-s | para |

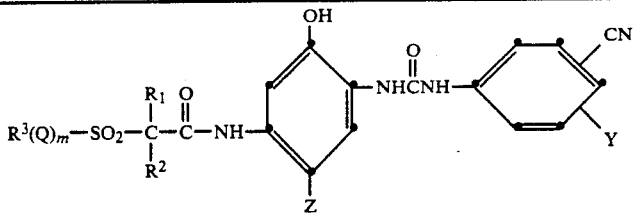

| | $R_1$ | $R_2$ | $R_3$ | Q | m | Z | Y | —CN |
|---|---|---|---|---|---|---|---|---|
| II-18 | $-C_2H_5$ | $-C_2H_5$ | 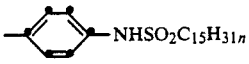 | | 0 | 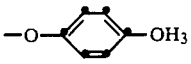 | —Cl meta | para |
| II-19 | iPr | $-H$ | $-C_{16}H_{33}$-n | NH | 1 | $-H$ | $-SO_2-C_3H_7$-n para | meta |
| II-20 | $-C_5H_{9}$-cyclo | $-H$ | 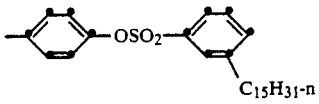 | $-O-$ | 1 | 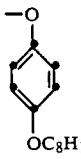 | 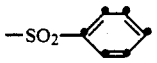 meta | para |
| II-21 | -n-Bu | -n-Bu | $-C_{12}H_{25}$-n | | 0 | 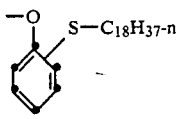 | —Cl para | meta |

The compounds and couplers used in this invention are, in general, known compounds and can be prepared by techniques known in the art. Compounds, described in the copending application referred to above on page 7 are novel and can be prepared by the procedures described in that application, the disclosures of which are incorporated herein.

The coupler combinations of this invention can be incorporated in silver halide emulsions and the emulsions can be coated on a support to form a photographic element. Alternatively, one or both of the couplers can be incorporated in the same or different photographic elements adjacent the silver halide emulsion where, during development, the coupler will be in reactive association with development products such as oxidized color developing agent.

The photographic elements can be either single color or multicolor elements. In a multicolor element, the cyan dye-forming coupler is usually associated with a red-sensitive emulsion, although it could be associated with an unsensitized emulsion or an emulsion sensitized to a different region of the spectrum. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art.

A typical multicolor photographic element comprises a support bearing a cyan dye image-forming unit comprising at least one red-sensitive silver halide emulsion layer having associated therewith at least one cyan dye-forming coupler, a magenta image forming unit comprising at least one green-sensitive silver halide emulsion layer having associated therewith at least one magenta dye-forming coupler and a yellow dye image-forming unit comprising at least one blue-sensitive silver halide emulsion layer having associated therewith at least one yellow dye-forming coupler. The dry layer thickness of individual emulsion layer units can be on the order of 0.5 to 6μ thick on a dry basis. The element can contain additional layers, such as filter layers, interlayers, overcoat layers, subbing layers, and the like. The element typically will have a total thickness (excluding the support) of from 5 to 30μ.

In the following discussion of suitable materials for use in the elements of this invention, reference will be made to *Research Disclosure*, December 1978, Item 17643, published by Kenneth Mason Publications, Ltd., The Old Harbourmaster's, 8 North Street, Emsworth, Hampshire P010 7DD, ENGLAND, the disclosures of which are incorporated herein by reference. This publication will be identified hereafter by the term "*Research Disclosure.*"

The silver halide emulsions employed in the elements of this invention can be comprised of silver bromide, silver chloride, silver iodide, silver chlorobromide, silver chloroiodide, silver bromoiodide, silver chlorobromoiodide or mixtures thereof. The emulsions can include silver halide grains of any conventional shape or size. Specifically, the emulsions can include coarse, medium or fine silver halide grains. High aspect ratio tabular grain emulsions are specifically contemplated, such as those disclosed by Wilgus et al U.S. Pat. Nos. 4,434,226, Daubendiek et al 4,414,310, Wey 4,399,215, Solberg et al 4,433,048, Mignot 4,386,156, Evans et al 4,504,570, Maskasky 4,400,463, Wey et al 4,414,306, Maskasky 4,435,501 and 4,643,966 and Daubendiek et al 4,672,027 and 4,693,964. Also specifically contemplated are those silver bromoiodide grains with a higher molar proportion of iodide in the core of the grain than in the periphery of the grain, such as those described in GB No. 1,027,146; JA No. 54/48,521; U.S. Pat. Nos. 4,379,837; 4,444,877; 4,665,012; 4,686,178; 4,565,778; 4,728,602; 4,668,614; 4,636,461; EP No. 264,954. The silver halide emulsions can be either monodisperse or polydisperse as precipitated. The grain size distribution of the emulsions can be controlled by silver halide grain separation techniques or by blending silver halide emulsions of differing grain sizes.

Sensitizing compounds, such as compounds of copper, thallium, lead, bismuth, cadmium and Group VIII noble metals, can be present during precipitation of the silver halide emulsion.

The emulsions can be surface-sensitive emulsions, i.e., emulsions that form latent images primarily on the surfaces of the silver halide grains, or internal latent image-forming emulsions, i.e., emulsions that form latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

The silver halide emulsions can be surface sensitized. Noble metal (e.g., gold), middle chalcogen (e.g., sulfur, selenium, or tellurium), and reduction sensitizers, employed individually or in combination, are specifically contemplated. Typical chemical sensitizers are listed in *Research Disclosure*, Item 17643, cited above, Section III.

The silver halide emulsions can be spectrally sensitized with dyes from a variety of classes, including the polymethine dye class, which includes the cyanines, merocyanines, complex cyanines and merocyanines (i.e., tri-, tetra-, and poly-nuclear cyanines and merocyanines), oxonols, hemioxonols, styryls, merostyryls, and streptocyanines. Illustrative spectral sensitizing dyes are disclosed in *Research Disclosure*, Item 17643, cited above, Section IV.

Suitable vehicles for the emulsion layers and other layers of elements of this invention are described in Research Disclosure Item 17643, Section IX and the publications cited therein.

In addition to the couplers described herein the elements of this invention can include additional couplers as described in Research Disclosure Section VII, paragraphs D, E, F and G and the publications cited therein. These additional couplers can be incorporated as described in Research Disclosure Section VII, paragraph C and the publications cited therein.

The coupler combinations of this invention can be used with bleach accelerator releasing couplers as described in European Patent Application No. 0,193,389 A and U.S. Pat. No. 4,912,024.

The coupler combinations of this invention can be used with colored masking couplers as described in U.S. Pat. No. 4,883,746.

The photographic elements of this invention can contain brighteners (Research Disclosure Section V), antifoggants and stabilizers (Research Disclosure Section VI), antistain agents and image dye stabilizers (Research Disclosure Section VII, paragraphs I and J), light absorbing and scattering materials (Research Disclosure Section VIII), hardeners (Research Disclosure Section XI), plasticizers and lubricants (Research Disclosure Section XII), antistatic agents (Research Disclosure Section XIII), matting agents (Research Disclosure Section XVI) and development modifiers (Research Disclosure Section XXI).

The photographic elements can be coated on a variety of supports as described in Research Disclosure Section XVII and the references described therein.

Photographic elements can be exposed to actinic radiation, typically in the visible region of the spectrum, to form a latent image as described in Research Disclosure Section XVIII and then processed to form a visible dye image as described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

Preferred color developing agents are p-phenylene diamines. Especially preferred are 4-amino-3-methyl-N,N-diethylaniline hydrochloride, 4-amino-3-methyl-N-ethyl-N-β-(methanesulfonamido)ethylaniline sulfate hydrate, 4-amino-3-methyl-N-ethyl-N-β-hydroxyethylaniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

With negative working silver halide this processing step leads to a negative image. To obtain a positive (or reversal) image, this step can be preceded by development with a non-chromogenic developing agent to develop exposed silver halide, but not form dye, and then uniform fogging of the element to render unexposed silver halide developable. Alternatively, a direct positive emulsion can be employed to obtain a positive image.

Development is followed by the conventional steps of bleaching, fixing, or bleach-fixing, to remove silver and silver halide, washing and drying.

The following examples further illustrate this invention. In these examples, comparative couplers having the following structures were employed:

Comparative Image Couplers

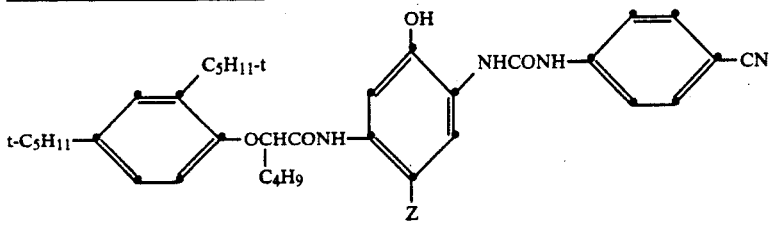

Coupler C-1

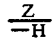

Coupler C-2

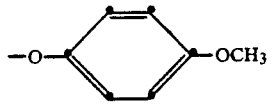

The structures of couplers of the invention are shown in Tables I and II above.

EXAMPLES 1-5

Photographic elements were prepared with the following layers, in the order indicated, on a cellulose acetate film support:

Layer 1

Red sensitized AgBrI emulsion (having an average grain diameter of 0.52 μm, 6.4 mole % I) (1.61 g Ag/m$^2$, 2.69 g gel/m$^2$), cyan image coupler (see Table III) and cyan DIR coupler (see Table III). Equimolar quantities of image couplers were used in the elements and the DIR couplers were used in amounts that would give essentially the same density and gamma in each of the elements after exposure and processing.

Layer 2

Overcoat layer of gelatin (1.08 g/m$^2$) and Hardener bisvinylsulfonylmethane coated at 1.75% by weight of total gelatin.

The dried coatings were exposed (1/15 sec.) to daylight through a graduated density step wedge and processed at 37.8° C., as follows:

| | |
|---|---|
| color developer | 3.25 min. |
| bleach (Fe-EDTA) | 4 min. |
| wash | 3 min. |
| fix | 4 min. |
| wash | 3 min. |

color developer composition:

| | |
|---|---|
| 4-amino-3-methyl-N-ethyl-beta-hydroxyethylanaline sulfate | 3.35 g/l |
| $K_2SO_3$ | 2.0 g/l |
| $K_2CO_3$ | 30.0 g/l |
| KBr | 1.25 g/l |

-continued

| | |
|---|---|
| KI | 0.0006 g/l |
| adjusted to pH = 10.0 | |

Sharpness was evaluated by calculating AMT acutance values for a 35 mm system, as described in J. SMPTE, 82, 1009 (1973). Larger values of AMT indicate a sharper image is obtained. The results are reported in Table III.

TABLE III

| Example | Image Coupler (g/m$^2$) | DIR Coupler (g/m$^2$) | 35 Sys. AMT. |
|---|---|---|---|
| 1 | C-1(0.85) | I-1(0.043) | 92.4 |
| 2 | II-2(0.88) | I-1(0.043) | 94.5 |
| 3 | C-2(1.13) | I-1(0.086) | 94.6 |
| 4 | II-1(1.06) | I-1(0.086) | 96.4 |
| 5 | II-5(1.05) | I-1(0.086) | 96.6 |

The above data show a clearly discernible improvement in sharpness is obtained when a DIR coupler is used in combination with a 4-equivalent cyan dye-forming phenolic coupler having a para-cyanophenylureido group in the 2-position, and a sulfo containing ballast in the 5-position (II-2) vs a phenoxy ballast (C-1) in the 5-position. A similar result is obtained with the 2-equivalent couplers II-1 and II-5 vs C-2. It should be noted that two-equivalent image couplers give better sharpness than do four-equivalent image couplers.

EXAMPLES 6-7

Color photographic elements were prepared with the following layers, in the order indicated, on a cellulose acetate film support.

Layer 1

A slow cyan dye-forming layer (SC) comprising a blend of a red-sensitized 0.42 μm silver bromoiodide emulsion (6.1 mol % I) at 1.29 g Ag/m$^2$ and a red-sensitized 0.21 μm AgBrI emulsion (4.8 mole % I) at 0.43 g Ag/m$^2$, gelatin (2.69 g/m$^2$), a masking coupler 1-hydroxy-4-(4-[2-(8-acetamido-1-hydroxy-3,6-disulfonaphthyl)azo]phenoxy)-2-(Δ-[2,4-di-tert.-amylphenoxy]butyl)naphthamide dipyridine salt (0.041 g/m$^2$), a cyan dye-forming coupler (see SC in Table IV) and a DIR coupler (see SC in Table IV).

Layer 2

A fast cyan dye-forming layer (FC) comprising a 0.76 μm silver bromoiodide emulsion (6 mole % I) at 1.08 g Ag/m², gelatin (1.61 g/m²), a cyan dye-forming coupler (see FC in Table IV) and a DIR coupler (see FC in Table IV).

Layers 3 and 4

Gelatin at 2.85 g/m².

Layer 5

A gelatin overcoat layer (2.8 g/m²) hardened with bisvinylsulfonylmethane at 1.75% by weight of total gelatin. Equimolar quantities of the image coupler (C-1 or II-1) were used and the quantity of DIR coupler (I-2) was chosen to give essentially the same density and gamma in the exposed and processed element.

The dried elements were exposed and processed as in the preceding examples.

TABLE IV

| Example | Image Coupler (g/m²) | | DIR Coupler (g/m²) | | 35 Sys. AMT. |
|---|---|---|---|---|---|
| 6 | C-1 | FC-0.48<br>SC-0.77 | I-2 | FC-0.033<br>SC-0.019 | 92.6 |
| 7 | II-1 | FC-0.60<br>SC-0.97 | I-2 | FC-0.059<br>SC-0.050 | 94.8 |

The above data show that a combination of a DIR coupler such as II-2 with a phenolic cyan dye-forming coupler having both a p-cyanophenylureido group in the 2-position, and a sulfo-containing ballast in the 5-position provides a sharpness improvement in comparison to a similar coupler combination in which the cyan dye-forming coupler does not have a sulfo-ballast in the 5-position.

EXAMPLES 7-21

Multicolor photographic elements were prepared having the following schematic structure. In this structure the numbers in parenthesis show the coverage in g/m².

UV Absorbing Overcoat Layer
Fast Yellow Image Forming Layer
Slow Yellow Image Forming Layer
Yellow Filter Layer
Fast Magenta Image Forming Layer -continued Slow Magenta Image Forming Layer
Gelatin Interlayer
Fast Cyan Dye Forming Layer (FC):
Fast Red Sensitized Tabular Grain AgBrI, 6 mol % I, (0.81 g Ag/m²) Emulsion
cyan dye forming coupler (see FC in Table V)
DIR coupler (see FC in Table V)
gelatin (1.13 g/m²)
Slow Cyan Dye forming Layer (SC):
Slow Red Sensitized emulsion blend of tabular grains AgBrI, 3 mol % I, (1.40 g Ag/m²) and cubic AgBrI, 3 mol % I, grains (0.27 g Ag/m²)
cyan dye forming coupler (see SC in Table V)
DIR coupler (see SC in Table V) (0.052 g/m²)
Antihalation Layer
Film Support The amounts of couplers in each of the cyan dye forming layers were chosen to give essentially the same density and contrast in the exposed and processed elements. The dried coatings were exposed (1/500 sec), through a graduated density step wedge (Wratten 29 filter), and processed for 3¼ minutes in the C-41 process described in the British Journal of Photography Annual, 1977, pages 201-205. The AMT acutance values for 35 mm film system were calculated as described in the previous example and the red separation and neutral speeds were measured. The following Table V reports AMT acutance for the normal exposure (i.e. the region exposed by a camera calibrated to ANSI standards) and for an average of the normal exposure and one stop on either side. The speed reported is the difference in speed between the comparison coating and the invention, and is for a red separation exposure. Sets of coatings exposed and processed together are separated by a double space.

These data show improvement in acutance for the invention compared with control coatings contain image coupler C-1. In addition it shows an increase in red speed in all cases. It will be noted that in some instances there is a relationship between speed and acutance; i.e. a more dramatic increase in acutance may accompany a less dramatic increase in speed.

TABLE V

| EX. | Imaging Coupler Layer (g/m2) | Dir Coupler Layer (g/m2) | Red Speed (Log E) | 35MM System AMT (normal) | 35MM System AMT (average of under, normal and over) |
|---|---|---|---|---|---|
| 8 | C-1 FC(0.32), SC(0.97) | I-2 FC(0.028), SC(0.045) | Check | 89.9 | 88.5 |
| 9 | II-3 FC(0.33), SC(1.01) | I-2 FC(0.034), SC(0.052) | +0.08 | 91.1 | 90.7 |
| 10 | II-4 FC(0.40), SC(1.23) | I-2 FC(0.060), SC(0.080) | +0.09 | 92.9 | 92.7 |
| 11 | C-1 FC(0.32), SC(0.97) | I-4 FC(0.031), SC(0.049) | Check | 89.4 | 88.1 |
| 12 | II-3 FC(0.33), SC(1.01) | I-4 FC(0.038), SC(0.057) | +0.08 | 90.7 | 90.4 |
| 13 | II-4 FC(0.40), SC(1.23) | I-4 FC(0.067), SC(0.086) | +0.08 | 89.6 | 90.1 |
| 14 | C-1 FC(0.32), SC(0.97) | I-3 FC(0.028), SC(0.047) | Check | 91.3 | 88.8 |
| 15 | II-4 FC(0.40), SC(1.23) | I-3 FC(0.054), SC(0.080) | +0.05 | 93.9 | 93.1 |
| 16 | C-1 FC(0.32), SC(0.97) | I-1 FC(0.025), SC(0.034) | Check | 88.6 | 87.8 |
| 17 | II-4 FC(0.40), SC(1.23) | I-1 FC(0.042), SC(0.062) | +0.08 | 88.8 | 88.9 |
| 18 | C-1 FC(0.32), SC(0.97) | I-2 FC(0.030), SC(0.045) | Check | 90.9 | 89.5 |
| 19 | II-2 FC(0.33), SC(1.01) | I-2 FC(0.038), SC(0.056) | +0.07 | 92.5 | 91.9 |
| 20 | C-1 FC(0.32), SC(0.97) | I-1 FC(0.025), SC(0.034) | Check | 88.5 | 88.1 |
| 21 | II-2 FC(0.33), SC(1.01) | I-1 FC(0.032), SC(0.043) | +0.09 | 88.7 | 89.1 |

The invention has been described in detail with particular reference to preferred embodiments thereof, but it will be understood that variations and modifications can be effected within the spirit and scope of the invention.

What is claimed is:

1. A color photographic element comprising a support and a silver halide emulsion layer having associated therewith a DIR compound having the structure I:

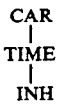

I.

wherein:

CAR is a carrier moiety;

TIME is a timing group having one of the structures;

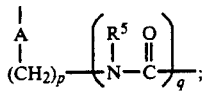

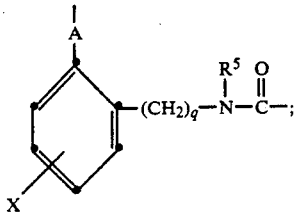

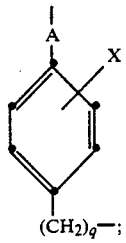

and

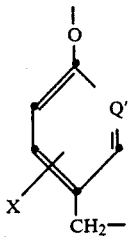

where:

p is 1 to 4;

q is 0 or 1;

A is —O— or

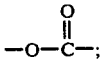

$R^5$ is hydrogen, alkyl of 1–20 carbon atoms or aryl of 6 to 20 carbon atoms;

X is hydrogen and one or more substituents independently selected from hydroxy, cyano, fluoro, chloro, bromo, iodo, nitro, alkyl, alkoxy, aryl, aryloxy, alkoxycarbonyl, aryloxycarbonyl, carbonamido, and sulfonamido;

Q' is —N= or

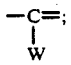

W is a substituent with a $\sigma_m$ value greater than 0.0 and

INH is a development inhibitor moiety; together with a cyan dye-forming coupler having the structure II:

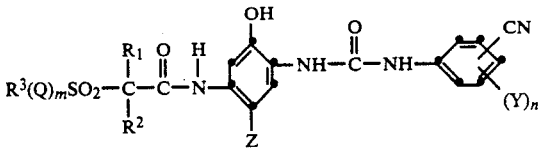

II.

wherein:

m is 0 or 1;

n is 0, 1 or 2;

Y is halogen, or sulfonyl;

Q is —O— or —NH—;

$R^1$ is an unsubstituted or a substituted, straight or branched chain alkyl group having from 1 to about 20 carbon atoms, an unsubstituted or a substituted cycloalkyl group having from 3 to about 8 carbon atoms in the ring, an alkylcarbonyl or an alkoxycarbonyl group having from 1 to about 20 carbon atoms in the alkyl or the alkoxy moiety;

$R^2$ is as defined for $R^1$ or is hydrogen;

$R^3$ is an unsubstituted or substituted alkyl group having from 1 to about 24 carbon atoms, an unsubstituted or a substituted cycloalkyl group having from 3 to about 8 carbon atoms in the ring, an unsubstituted or a substituted aryl group having from 6 to about 24 carbon atoms, or an unsubstituted or a substituted heterocyclic group having from 3 to about 8 atoms in the heterocyclic ring;

when $R^3$ is a primary alkyl group, $R^1$ contains at least 2 carbon atoms;

Z is hydrogen or a coupling-off group; and the —CN substituent on the phenyl ureido group is para or meta to the ureido group.

2. A color photographic element of claim 1 wherein, in structure II, the cyano group is in the para position and n is 0.

3. A color photographic element of claim 2, wherein, in structure II, $R^1$ is alkyl of 1 to 20 carbon atoms and $R^2$ is hydrogen or alkyl of 1 to 4 carbon atoms.

4. A color photographic element of claim 2, wherein, in structure II, $R^1$ is alkyl of 1 to 14 carbon atoms, $R^2$ is hydrogen and $R^3$ is alkyl of 2 to 24 carbon atoms.

5. A photographic element of claim 1, wherein the DIR coupler has one of the structures:

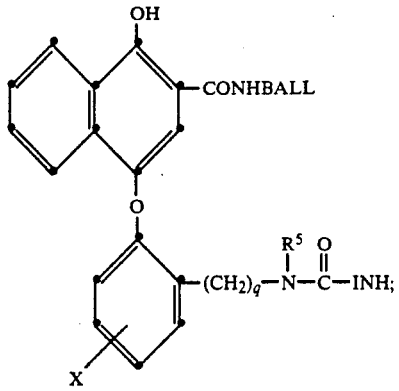

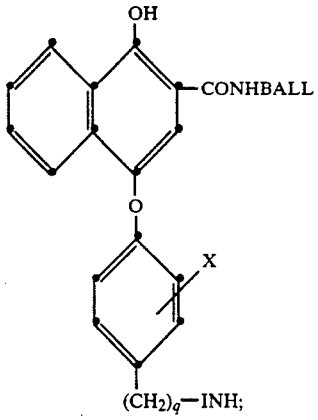

or

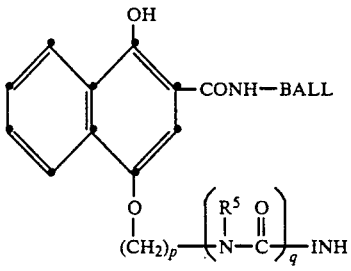

wherein:

BALL is a ballast group;

INH is a mercaptotetrazole or a benzotriazole inhibitor;

X is hydrogen, cyano, nitro or sulfonamido;

p is 1–4 and q is 0 or 1.

6. A photographic element of claim 1 wherein the DIR compound has the structure:

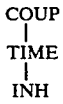

wherein

COUP is a coupler moiety;

INH is a development inhibitor moiety; and

TIME is a timing group having the structure

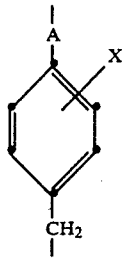

wherein:

A is —O— or

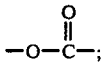

and

X is hydrogen and one or more substituents independently selected from hydroxy, cyano, fluoro, chloro, bromo, iodo, nitro, alkyl, alkoxy, aryl, aryloxy, alkoxycarbonyl, aryloxycarbonyl, carbonamido, and sulfonamido.

7. A photographic element of claim 1 wherein the cyan dye forming coupler has one of the structures:

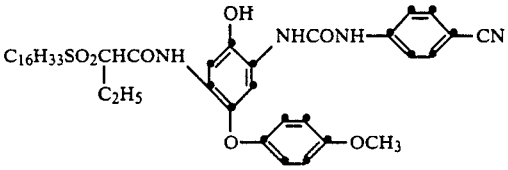

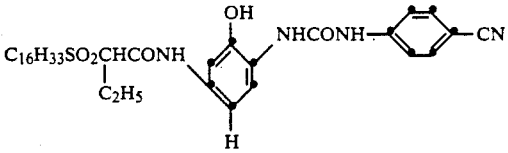

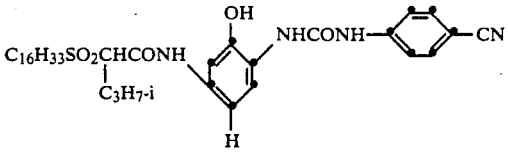

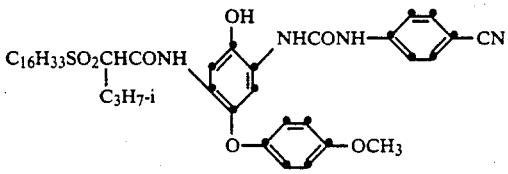

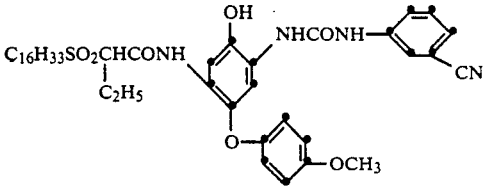

8. A photographic element of claim 1, wherein the DIR compound is a coupler having one of the structures:

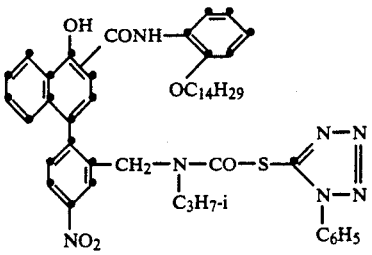

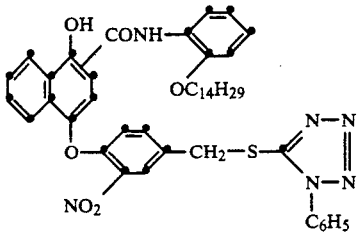

-continued

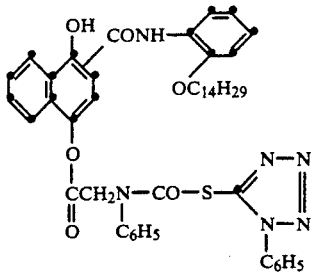

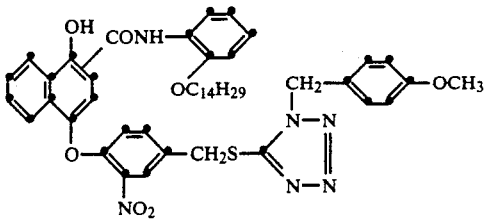

9. A color photographic element of claim 1, wherein the DIR compound is a cyan dye-forming DIR coupler and is contained in a red-sensitive silver halide emulsion layer together with the cyan dye-forming image coupler.

10. A color photographic element of claim 1, wherein the DIR compound is a yellow dye-forming DIR coupler and is contained in a red-sensitive silver halide emulsion layer together with the cyan dye-forming image coupler.

* * * * *